US006325503B1

(12) United States Patent
McCue, Jr. et al.

(10) Patent No.: US 6,325,503 B1
(45) Date of Patent: Dec. 4, 2001

(54) GREETING CARD FEEDER OPERATING SYSTEM

(75) Inventors: Thomas E. McCue, Jr.; Mark Garboden; Todd M. Gaasch, all of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/560,432

(22) Filed: Apr. 28, 2000

(51) Int. Cl.[7] ..... B41J 2/01

(52) U.S. Cl. ..... 347/101; 400/605; 101/483

(58) Field of Search ..... 347/101, 104, 347/8, 16, 5; 400/70, 188, 605, 68, 624, 625, 629, 648; 101/483; 271/9.09; 358/500; 399/107

(56) References Cited

U.S. PATENT DOCUMENTS

| | | | | |
|---|---|---|---|---|
| 4,791,457 | | 12/1988 | Shida . | |
| 5,000,596 | | 3/1991 | Naruki . | |
| 5,019,839 | | 5/1991 | Watanabe et al. . | |
| 5,116,034 | | 5/1992 | Trask et al. . | |
| 5,177,544 | | 1/1993 | Kimura et al. . | |
| 5,216,442 | * | 6/1993 | Parks et al. | 400/648 |
| 5,335,315 | * | 8/1994 | Yoshida et al. | 101/483 |
| 5,457,904 | * | 10/1995 | Colvin | 101/483 |
| 5,521,722 | * | 5/1996 | Colvill | 358/500 |
| 5,581,339 | * | 12/1996 | Jamzadeh | 347/232 |
| 5,595,380 | | 1/1997 | McCue, Jr. et al. . | |
| 5,603,493 | | 2/1997 | Kelly . | |
| 5,729,820 | * | 3/1998 | Jamzadeh et al. | 399/407 |
| 5,778,164 | * | 7/1998 | Watkins et al. | 101/483 |
| 5,838,338 | | 11/1998 | Olson . | |
| 5,957,447 | | 9/1999 | Sekine . | |
| 6,042,106 | | 3/2000 | Kelly et al. . | |
| 6,149,327 | * | 11/2000 | Ward et al. | 400/70 |
| 6,168,327 | * | 1/2001 | Tsuzuki | 400/188 |
| 6,173,649 | * | 1/2001 | Onishi | 101/483 |
| 6,267,518 | * | 7/2001 | Abe | 347/5 |
| 6,267,997 | * | 7/2001 | Ream et al. | 101/483 |

OTHER PUBLICATIONS

Hewlett–Packard Company U.S. Patent Application Serial No. 09/411959, filed Oct. 4, 1999, entitled "Auxiliary Print Media Tray for Printer".

* cited by examiner

*Primary Examiner*—Eugene Eickholt
(74) *Attorney, Agent, or Firm*—Flory L. Martin

(57) ABSTRACT

A hardcopy printing mechanism and a greeting card feeder retrofit kit therefor, along with an operating method are provided for printing images on a first-sized media, and on both surfaces a second-sized greeting card media without removing the first-sized media from its normal supply tray. The hardcopy device may be an electrophotographic or inkjet printer preferably equipped with a duplexer module which inverts media from a printed first surface to an opposing second surface for printing an image thereon. For a printer having an alignment surface, and a width adjuster to push the first-sized media against the alignment surface, the greeting card feeder includes a biasing member which pushes the card stock against the alignment surface. The retrofit kit includes a supply of pre-scored greeting card stock and a software program with a group of greeting card images for a consumer to select from to print store-bought quality greeting cards.

15 Claims, 9 Drawing Sheets

GREETING CARD FEEDER OPERATING SYSTEM

FIELD OF THE INVENTION

The present invention relates generally to hardcopy devices which advance media through a printzone for printing, such as electrophotographic printers or as illustrated herein, inkjet printing mechanisms. More particularly, the present invention relates to an operating system for controlling a greeting card feeder module used in conjunction with a duplexing printing mechanism to easily print greeting cards which are comparable with store-bought greeting cards.

BACKGROUND OF THE INVENTION

The term "hardcopy device" includes a variety of printers and plotters, including those using inkjet and electrophotographic technologies to apply an image to a hardcopy medium, such as paper, transparencies, fabrics, foils and the like. Inkjet printing mechanisms print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with a full supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multi-color cartridges, several printheads and reservoirs are combined into a single unit, with each reservoir/printhead combination for a given color also being referred to herein as a "pen." As the inkjet industry investigates new printhead designs, one trend is toward using a "snapper" reservoir system where permanent or semi-permanent printheads are used and a reservoir carrying a fresh ink supply is snapped into place on the printhead.

Each pen has a printhead formed with very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, the Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the printhead is propelled through a printzone back and forth across the page, ejecting drops of ink in a desired pattern as it moves. By selectively energizing the resistors as the printhead moves across the page, the ink is expelled in a pattern on the print media to form a desired image (e.g., picture, chart or text). The nozzles are typically arranged in linear arrays usually located side-by-side on the printhead, parallel to one another, and perpendicular to the scanning direction of the printhead, with the length of the nozzle arrays defining a print swath or band.

That is, if all the nozzles of one array were continually fired as the printhead made one complete traverse through the printzone, a band or swath of ink would appear on the sheet. The width of this band is known as the "swath height" of the pen, the maximum pattern of ink which can be laid down in a single pass. The print media, such as a sheet of paper, is moved through the printzone typically one swath width at a time, although some print schemes move the media incrementally by, for instance, halves or quarters of a swath width for each printhead pass to obtain a shingled drop placement which enhances the appearance of the final image.

Whether the printing mechanism uses either a snapper cartridge system, an off-axis system, a replaceable cartridge system or some other inkjet system, drop placement on the media must be coordinated with the incremental advance of the media through the printzone for sharp, vivid images and text, which are free of print defects, such as color banding, improper spacing, and printed line overlapping. Many types of inkjet printing mechanisms use a series of conventional paper drive rollers or tires to frictionally engage the print media and incrementally advance the media through the printzone, moving either a full or fractional swath width.

One such media advancing system is described in U.S. Pat. No. 5,838,338, currently assigned to the Hewlett-Packard Company. One inkjet printer, specifically the DeskJet® 970 model color inkjet printer sold by the Hewlett-Packard Company, has a duplexer unit. Other printers, such as the DeskJet® 930 and 950 models of color inkjet printers, also sold by the Hewlett-Packard Company, may be used in conjunction with an optional duplexing module sold by the Hewlett-Packard Company as the Automatic Two-Sided Printing Module, stock no. C6463A. As the home computer market grows, as well as business applications, consumers have a desire to print greeting cards on their own printers, and as print quality advances increase, current inkjet printers have the ability to produce greeting cards which are of a quality comparable to a store bought greeting card. Additionally, with the increasing popularity of the Internet and electronic commerce, there are many websites which offer a variety of greeting card designs that consumers can download and print. For example, one such website may be located at www.printablecards.com. Indeed, in the future stores may even offer greeting card media in pre-cut sizes, such as 7×10 inch sheets which could be pre-scored to easily fold into a 5×7 inch greeting card.

Unfortunately, even with the ready availability of both pre-cut media and greeting card designs on the Internet and other software programs, most people still do not print their own greeting cards because of the complexity of the process, particularly when using currently available inkjet printers. Most consumers typically print on letter size media and only occasionally wish to print a greeting card, such as for holidays, birthdays and the like. For example, using a Microsoft Windows® based operating system on a home computer, printing a greeting card is a complicated lengthy process both in terms of physical hardware changes that need to be made to the printer, as well as software manipulation.

For example, FIGS. 5A and 5B together form a flow chart illustrating a prior art greeting card printing method. Since the drawings are labeled 5A and 5B, we will begin our discussion of this method with the letter C for the first step. Assuming an inkjet printer has been being used in a normal fashion for printing on letter-sized (8 ½×11 inch), in a removing step C, the user must first remove this normal sized paper (or other media) from the input tray and find a place to put the stack, which for some users with a slightly a cluttered work area may be a difficult task in itself. Then in a loading step D, the greeting card media is loaded into the input tray of the printer. Then in a width adjusting step E, the media width adjuster must be moved to snuggly press the stack against the side of the input tray. Then in a length adjusting step F, the media length adjuster must then be moved to snuggly press the greeting card stack back toward the media picking and feed mechanism.

Now the greeting card media has been loaded into the printer, the method continues with a software running step G, where the user then begins to run a particular greeting card software application. As mentioned above, this software application might be something which the user purchased, or it may be a design downloaded from the Internet or something custom created by the user using word processing or graphics programs. Then in a selecting step H, the user selects which greeting card to print. Then to begin the printing process, in an illustrated Microsoft Windows® brand based software application, in a selecting step I, the user must first select the "File" menu and then select the "page set-up" option. In another selecting step J, in the "page set-up" pop-up window, the user must then select the greeting card media size option, here illustrated as 7×10 inches. In another selecting step K in the "page set-up" pop-up window, the user must then select two-sided printing so a picture image or other text appears on the front of the finished card, and a greeting appears on the inside of a card. Then in another selecting step L, having selected the media size in step J and duplex printing in step K, the user must then select the "ok" feature on the "page set-up" pop-up window to close this window and continue the operation.

In a further selecting step M, the user must then again enter the file menu and then select the option "print". Now transitioning from FIG. 5A to FIG. 5B, at the top we see another selecting step N, where under the print pop-up screen, the user must now select the properties option which generates another pop-up screen having several different layers of selection based upon the particular type of printer being used. Then in another selecting step, the user must select the "features" tab to bring the variety of features available into view. In a further selecting step P on the features screen, a user must select two-sided printing. Following this selection of two-sided printing, in a selecting step Q, the user must indicate that two-sided printing is desired by activating the "ok" feature to close the properties window. In a further selecting step R, the user must then select "ok" to close the print screen and initiate printing of the greeting card. Of course between steps Q and R, a user might also wish to select the number of copies of the card they would like to print if more than one card was desired.

Finally, in a printing step S, the printer finally prints the greeting card, performing the required duplexing operation to print on both the inside and outside of the card after which, the card is deposited by the printer in the output tray. Having completed this tortuous process to this point, the user must then return the printer to the normal operating state for, in this example, printing on letter-sized paper. In a moving step T, the user moves the media width adjuster on the printer to the far left position to begin to release the greeting card media. In another moving step U, the media length adjusters moved to the fully extended or "out" position so the remaining blank greeting card media can be removed from the input tray of the printer. It is apparent some users may wish to reverse steps T and U. Having removed the greeting card media from the input tray, in a loading step V, the normal sized paper or other media is returned to the input tray. After the media has been loaded, in an adjusting step W, the media width adjuster must be moved against the normal size media to push it tightly against the side of the input tray. Finally, in a length adjusting step X, the media length adjuster is pushed toward the rear of the printer, to move the media stack into engagement with the media picking and feed mechanisms to leave the printer ready for a normal print job.

In reviewing this earlier printing routine required to change from a normal printing mode to printing a greeting card and then return the printer to the normal state, nearly every letter of the alphabet has been used. Indeed, steps I and M really include two steps, one of selecting the file menu and the other then selecting which option is required under the file menu. Furthermore, between steps U and V an additional step could have been added for the process of unloading the greeting card media. Moreover, if the printer was not capable of duplex printing, while steps K and P could be eliminated after a user printed one side of the greeting card in step S, the card would still need to be placed back in the top of the input tray media stack to allow printing on the other side of the card by repeating the remainder of the steps D through S, before moving on with steps T through the end to return the printer to normal sized media. Effectively, without the ability to print with an automatic duplexer, the method nearly doubles in length. This system is just far to complicated for the majority of simple users who wish to quickly print a greeting card and continue on with other tasks in their day. Moreover, since most users only occasionally print greeting cards and this is not a daily occurrence they must remember all of these steps in order to successfully print a greeting card without unnecessarily wasting media where several months may go by between uses for instance, between Christmas and Valentine's Day, between Valentine's Day and Easter, and then perhaps between Easter and the following Christmas. Unfortunately, the only clear memory a user may have of the last time they tried printing a greeting card is that it was just too complicated and troublesome, leaving them to conclude it would be far easier just to go to the store and buy a card.

Thus, a need exists for a simple uncomplicated way for users to print greeting cards which is quick and easy to repeat, with minimal interruption of normal printing.

SUMMARY OF THE INVENTION

According to one aspect of the present invention, a method is provided for printing images on a first-sized media and on opposing first and second surfaces a second-sized media. The method includes the step of providing a hardcopy printing mechanism having a frame, a first input device for storing a supply of the first-sized media, a duplexer unit for inverting media, a controller responsive to input signals to print images, and a second input device for receiving a sheet of the second-sized media. In a loading step, a sheet of the second-sized media is loaded into the second input device. In an initiating step, a software program is initiated. The software program includes a selection of images each having a first portion and a second portion. The method also includes the steps of selecting one of the images from the selection of images, and generating input signals for the controller in response to the selecting step. In a first printing step, the first portion of the selected image is printed on the first surface of the loaded sheet of second-sized media, and thereafter, the second portion of the selected image is printed on the second surface of the second-sized media, while retaining a supply of the first-sized media in the first input device.

An overall goal of the present invention is to provide a hardcopy device with a greeting card feeder module and operating system which is easy to use.

Another goal of the present invention is to provide a hardcopy device with a greeting card feeder module and operating system which reliably produces clear crisp images.

A further goal of the present invention is to provide a retrofit kit, including hardware, software, and optionally a sample supply of greeting card stock, which allows consumers, who have previously purchased a printer without a greeting card feeder module, the option of retrofitting their printer with a new greeting card feeder module and associated software.

An additional goal of the present invention is to provide a hardcopy device with a greeting card feeder module and operating system which allows a user to quickly switch between their normal print media, such as letter-sized paper, and specialty sized print stock, such as greeting card stock.

DETAILED DESCRIPTION OF THE PREFERRED EMBODIMENTS

Figure 1:
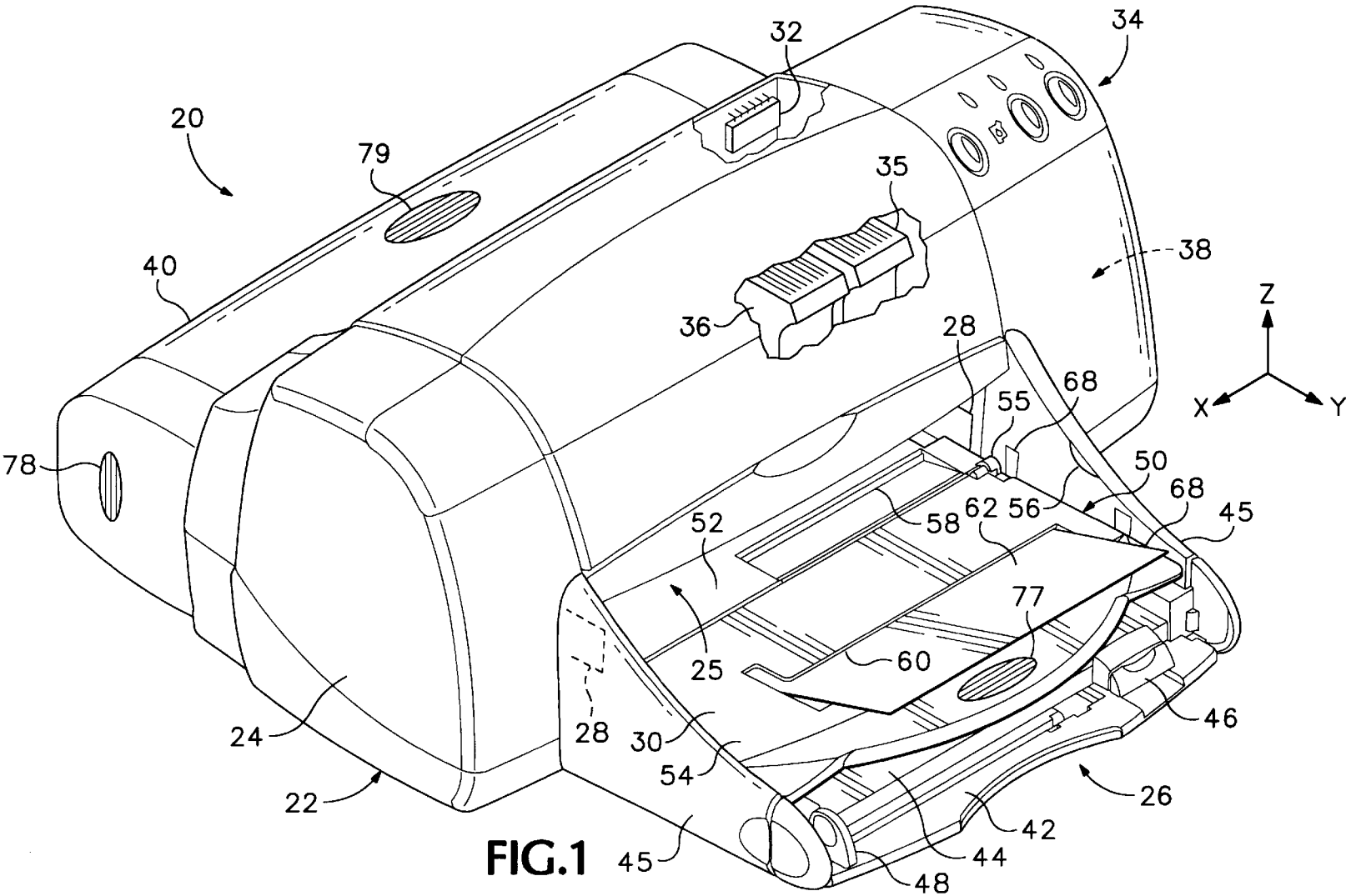
FIG. 1 is a, partially schematic, fragmented, perspective view of one form of a hardcopy printing device, here an inkjet printer having a duplexer device, and including one form of a greeting card feeder module and operating system of the present invention for printing on specialty-sized print media, and in particular, on greeting card stock.

FIG. 1 illustrates an embodiment of a hardcopy device, here shown as an inkjet printing mechanism, and in particular, an inkjet printer 20, constructed in accordance with the present invention, which may be used for printing for business reports, correspondence, desktop publishing, and in particular, for printing greeting cards, in an industrial, office, home or other environment. A variety of inkjet printing mechanisms are commercially available, although some of the more important advantages of the printer 20 may be appreciated best by people printing in a typical home environment. While it is apparent that the printer components may vary from model to model, the typical inkjet printer 20 includes a chassis 22 surrounded by a housing, casing or enclosure 24, typically of a plastic material. Sheets of print media are fed through a printzone 25 by a print media handling system 26 using a series of internal conventional media drive rollers (not shown). The print media may be any type of suitable sheet material, such as paper, transparencies, mylar, and the like, but for convenience, the normal print mode is illustrated using plain paper, such as letter-sized paper, as the normal print medium. After printing, a sheet exiting the printzone 25 is propelled onto a pair of retractable output drying wing members, such as wing 28. The pair of wings 28 momentarily hold a newly printed sheet above any previously printed sheets still drying in an output tray 30 before retracting to the sides to drop the newly printed sheet into the output tray.

The printer 20 also has a printer controller, illustrated schematically as a microprocessor 32, that receives instructions from a host device, typically a computer, such as a personal computer (not shown). Indeed, many of the printer controller functions may be performed by the host computer, by the electronics on board the printer, or by interactions therebetween. As used herein, the term "printer controller 32" encompasses these functions, whether performed by the host computer, the printer, an intermediary device therebetween, or by a combined interaction of such elements. The printer controller 32 may also operate in response to user inputs provided through a key pad 34 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

One or more inkjet cartridges, here illustrated as a black ink cartridge 35 and a color ink cartridge 36, may be slideably supported in a conventional manner by a carriage mechanism (not shown) for reciprocating travel back and forth across the printzone 25 for printing, and into a servicing region 38 for printhead maintenance and storage. The cartridges 35 and 36 are often called "pens" by those in the art. The printer 20 has a cartridge drive mechanism, such as a DC motor and drive gear assembly (not shown) coupled to drive the pens 35, 36 in this reciprocating fashion in response to control signals received from the controller 32. A conventional optical encoder device (not shown) may be used to provide the controller 32 with feedback information as to the position of the pens over the printzone 25. The illustrated color pen 36 is a tri-color pen, although in some embodiments, several discrete monochrome pens may be used. While the color pen 36 may contain a pigment based ink, for the purposes of illustration, pen 36 is described as containing three dye based ink colors, such as cyan, yellow and magenta. The black ink pen 35 is illustrated herein as containing a pigment based ink. It is apparent that other types of inks may also be used in pens 35, 36, such as paraffin based inks, as well as hybrid or composite inks having both dye and pigment characteristics.

The illustrated pens 35, 36 each have bodies that define reservoirs for storing a supply of ink therein. The bodies of pens 35, 36 each support conventional printheads (not shown), with each printhead having an orifice plate with a plurality of nozzles formed therethrough in a manner well known to those skilled in the art. The illustrated embodiment uses thermal inkjet printheads, although other types of printheads may be used, such as piezoelectric printheads. The printheads 35, 36 typically include a plurality of resistors which are associated with the nozzles. Upon energizing a selected resistor, a bubble of gas is formed with the bubble ejecting a droplet of ink from the nozzle and onto a sheet of media in the printzone 25 under the nozzle. The printhead resistors are selectively energized in response to firing command control signals received from the controller 32. The pens 35, 36 are illustrated as replaceable inkjet cartridges, which when emptied are removed and replaced with fresh cartridges each having new printheads. Thus, the illustrated printer 20 may be considered as a "replaceable cartridge" inkjet printer.

The illustrated printer 20 is fitted with a removable duplexer module 40, which provides for automatic auto-duplexing, that is, two-sided printing so an image may be applied to both sides of a sheet of media. Such a duplexer module, mentioned in the Background section above, is commercially available from the Hewlett-Packard Company as the Automatic Two- Sided Printing Module, stock no. C6463A, which may be used in conjunction with the DeskJet® 930 and 950 models of color inkjet printers. The Hewlett-Packard Company also offers the DeskJet® 970 model color inkjet printer which comes with this duplexer unit model installed. Thus, in the illustrated embodiment, the duplexer unit 40 serves as a portion of the media handling system 26.

Another portion of the media handling system 26 is the media input tray 42, which is shown in FIG. 1 as holding a stack of letter-sized paper 44. In the illustrated embodiment, the media tray 42 is designed as a drawer-type tray slidably supported between two fixed side panels 45 extending outwardly from a main body portion of the casing 24. Preferably, the input tray drawer 42 slides outwardly in the positive Y-axis direction to allow for ease of loading the media 44 in the tray. In referring to the background section above, the stack of paper 44 and the input tray 42 comprises the "normal" type of media which most users typically employ. Either before the input tray 42 is pushed back into the printing position shown in FIG. 1, a media length adjuster 46 and a media width adjuster 48 are pushed into contact with the stack 44 to hold the sheets firmly in a proper position for picking by the media drive rollers (not shown). In the illustrated embodiment, the length adjuster 46 pushes the media stack 44 in a negative Y-axis direction, and into engagement with the media picking mechanism, where as the width adjuster 48 pushes the stack into the negative X direction which serves to present the sheets to the pick rollers in an aligned, non-skewed fashion.

FIG. 1 shows the printer 20 equipped with one form of a greeting card feeder module 50, constructed in accordance with the present invention. The greeting card feeder module 50 includes a fixed portion 52 and a pivoting portion 54 which is pivotally attached to the fixed portion 52 by a pair of hinges, such as hinge 55. The hinge 55 allows the pivoting portion 54 to rotate upwardly to provide easier access to the media input tray 42. To temporarily hold the pivoting portion 54 above the media stack 44, one or both of the side panels 45 may have a door stop feature 56 which holds the pivoting portion 54 at an angled orientation to free a user's hands to adjust the media stack 44 and adjusters 46, 48. Preferably the door stop 56 is sized and positioned, in combination with the features of the greeting card feeder module 30 to allow gentle hand pressure to move the pivoting portion 54 over the stop when moving between the elevated and loading position and the lowered printing position. Together, the fixed portion 52 and the pivoting portion 54 of the greeting card feeder module 30 define the output tray portion 30 of printer 20. While the input tray 42 is preferably designed to hold a variety of different sizes of media, from 3×5 inches up to legal sized 8 ½×14 inch paper, or continuously fed Z-fold or banner type paper, including a stack of envelopes. However, some users may prefer the convenience of being able to feed a single envelope through the printzone 20 without having to remove the normal media 44. Thus, the fixed portion 52 of the greeting card feeder module may be formed to define a manual envelope feed slot 58.

Figure 2:
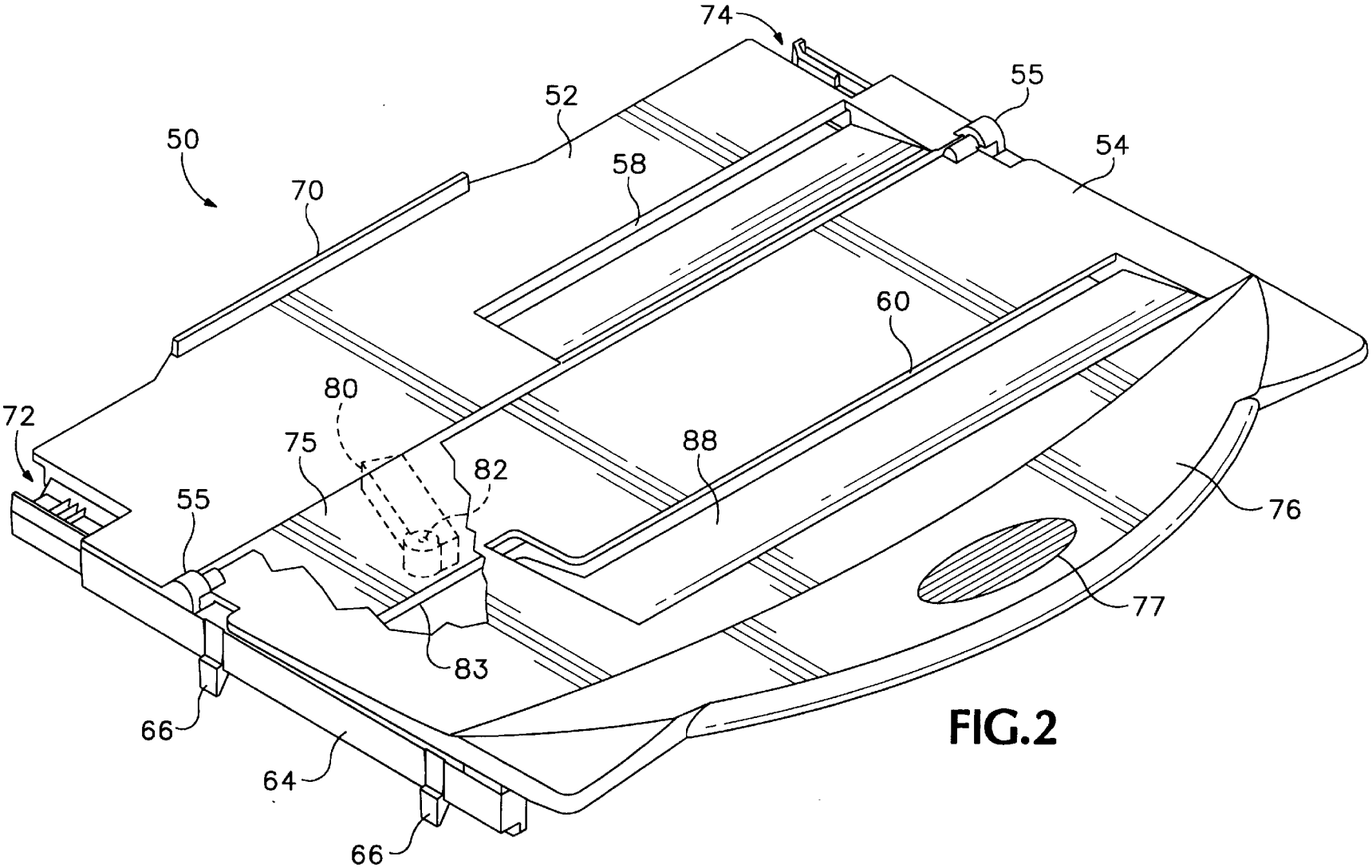
FIG. 2 is an enlarged perspective view of the greeting card feeder module of FIG. 1, shown removed from the printer.
Figure 3:
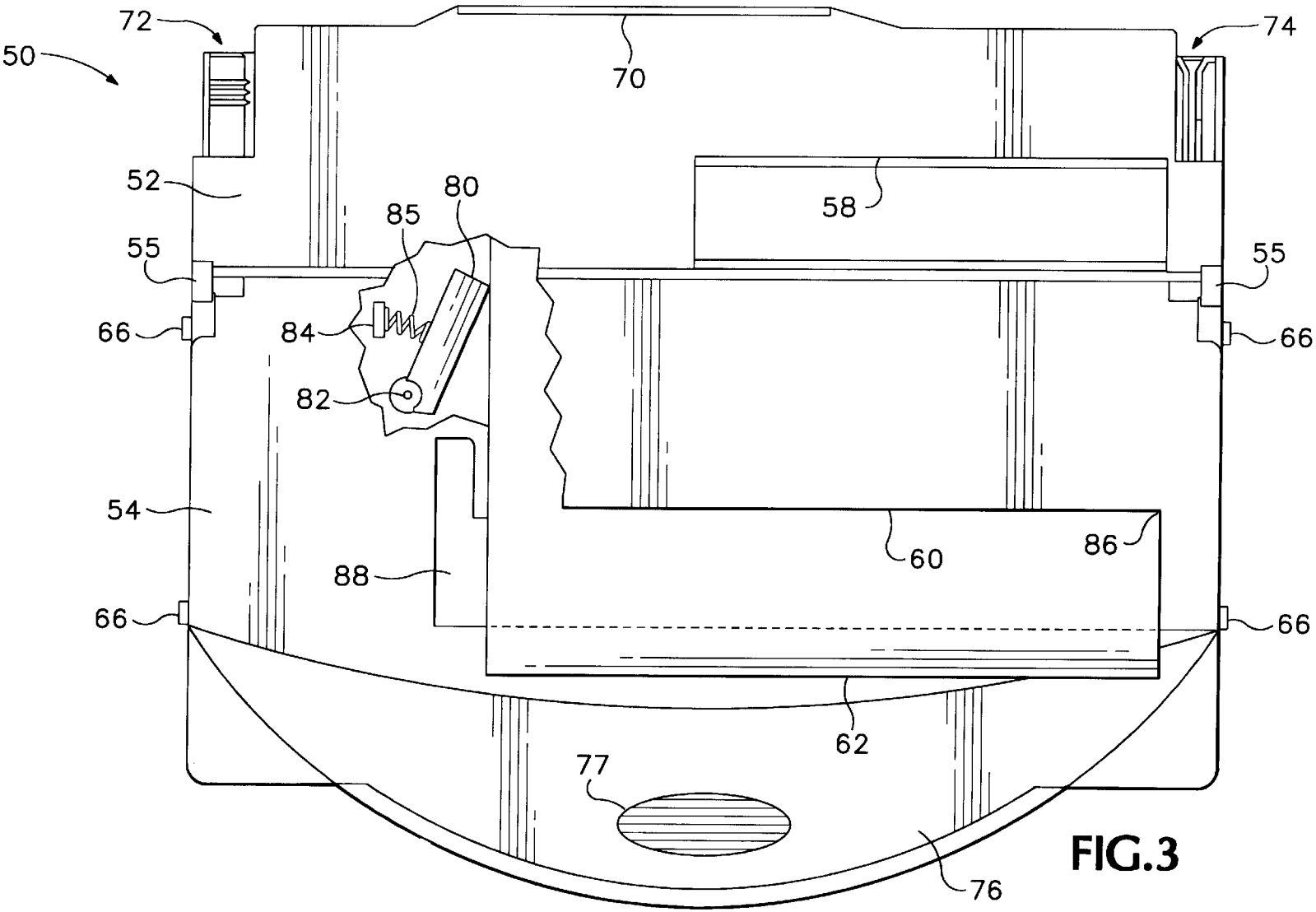
FIG. 3 is a fragmented, enlarged top plan view of the greeting card feeder module of FIG. 1, showing one form of a biasing device for pushing greeting card media toward the side of the module.

The pivoting portion 54 of the greeting card feeder module 50 defines a greeting card stock feed slot 60, shown in FIG. 1 with a standard sized piece of greeting card stock 62 inserted therein ready for printing. FIGS. 2 and 3 illustrate other features of the greeting card feeder module 50. For ease of compatibility with current printer designs, the fixed portion 52 of the module 50 may be of the same construction as current output tray designs, for instance, including a pair of extending side rails, such as side rail 64 which has a pair of snap fit members 66 extending downwardly therefrom for receipt by a pair of mating features such as features 68 formed within the inner portions of the fixed side panels 45 (see FIG. 1) other conventional assembly features of the fixed tray portion 52 may include a rear wall 70, and alignment features 72 and 74 which are used to positively receive the module 50 within the printer chassis 22 and align the module with other portions of the media handling system including the input or pick rollers and the media output rollers (not shown). As shown in FIG. 2, preferably the fixed portion 52 of the module has an extending platform portion 75 which extends beyond the hinges 55 to lie under a portion of the pivoting tray portion 54. One useful feature for this extending ledge 75 is that it makes it more difficult for a user to get their fingers, clothing, jewelry or other items caught or tangled in the internal moving portions of the printer, namely, the media pick and feed rollers (not shown). To aid a user in understanding intuitively that the pivoting portion 54 of the module 50 does indeed pivot in an upward direction, preferably a rounded front portion 76 of plate 54 is embossed or molded with a textured gripping region 77. Other embossed or molded tactile indicators are shown on the duplexer 40 in FIG. 1, including a pair of depressible installation/uninstallation buttons located to each side of the duplexer, such as button 78, and a jam-clearing door button 79. When button 79 is depressed, the top and rear portions of the duplexer casing are hinged to open and allow access to the internal rollers of the duplexer to allow easy removal of any jammed media.

FIG. 3 illustrates another important feature of the greeting card feeder 50, which is a width biasing member or push arm 80. Preferably the push arm 80 is pivotally attached to an undersurface 83 of the ledge portion 75 (see FIG. 2). Preferably the push arm 80 is biased away from a mounting feature 84 extending downwardly from the ledge undersurface 83 by a biasing member, such as a compression spring 85. The spring 85 serves to push arm 80 into engagement with the free side edge of the sheet of greeting card stock 62, as shown in FIG. 3. Since all commercial greeting cards are not cut exactly to a nominal width, here illustrated as 7 inches in width with a 10 inch length, this push arm width adjuster 80 advantageously serves to align the opposite edge of the card stock tightly against and alignment edge 86 of the input slot 60. Thus, use of the biasing arm 80 advantageously allows the greeting card feeder 50 to easily compensate for slight variations and differences in the widths of particular greeting card media which typically fall within commercial cut tolerances. Before leaving our discussion of the push arm 80, it is noted that a variety of other biasing mechanisms other than a coil compression spring 85 may be used to push the arm 80 into engagement with a sheet of greeting card stock 62. For instance, rather than a coil spring, a leaf spring may be used, or a torsional spring member wrapped around the mounting post 82, as well as tensioning springs which would pull the arm 80 into contact with the edge of the card stock.

Another useful feature of the pivoting plate 54 of the feeder 50 is a beveled ramp portion 88 which assists a user in guiding a sheet of card stock 62 into the feed slot 60. As far as how far back, that is in the negative Y direction, a user must insert a sheet of cardstock 62, most users soon develop an intuitive feel or understanding that a sheet of media must be pushed rearwardly into engagement with the pick rollers, since this is the standard practice when loading a normal stack of media 44 in the regular input tray 42, as well as when feeding an envelope through the manual feed slot 58. Thus, given that the feeder module 50 is designed for single sheet manual feeding, it is believed that a user's hand serves this rearward biasing function just as well if not better than any mechanical biasing member.

Figure 4:
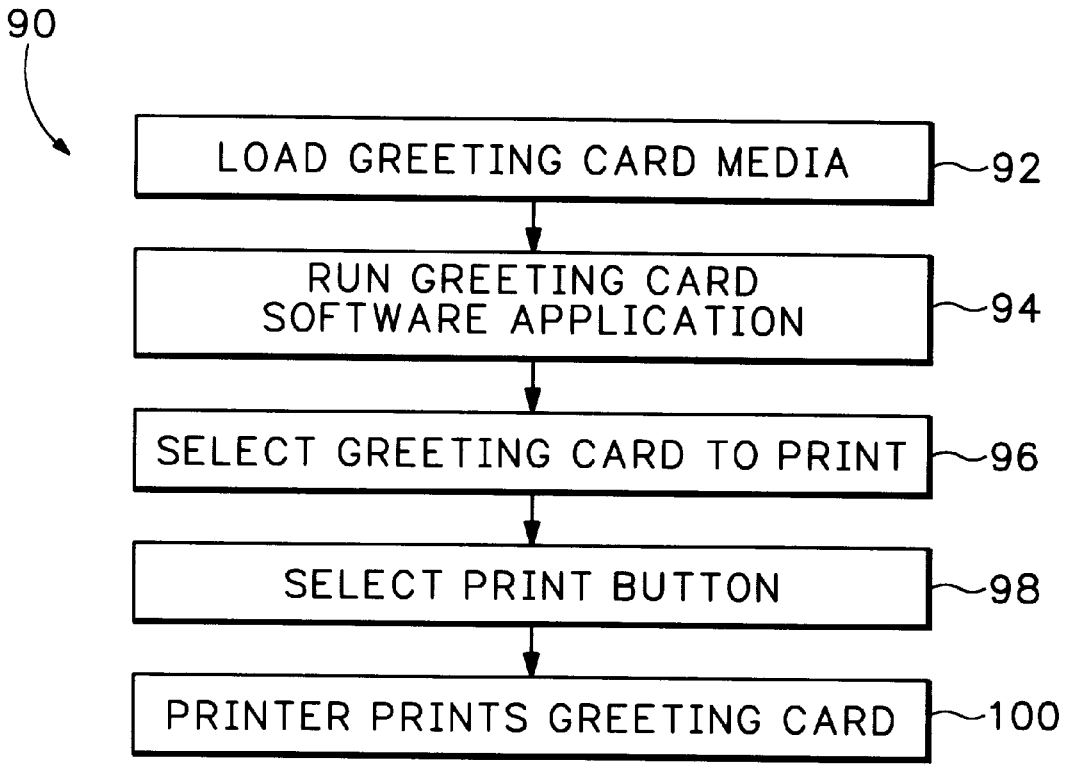
FIG. 4 is a flow chart illustrating one form of a greeting card feeder operating system of the present invention which may be used in the printer of FIG. 1.

FIG. 4 is a flowchart 90 illustrating one form of a greeting card feeder operating system, operated in accordance with the present invention using the greeting card feeder module 50, as assembled in printer 20 with the auto-duplexer unit 40 installed. In a loading step 92, a sheet of card stock 62 is loaded by hand into the feed slot 60 of the feeder module 50. During this loading process, the push arm 80 under the urging force of spring 85 automatically guides the card stock 62 into engagement with the right edge 86 of feed slot 60, as shown in FIG. 3. Most users intuitively know to push the card stock 62 all the way toward the rear of the printer, until the rearward most edge of sheet 62 encounters the media pick mechanism (not shown). Now the media is ready in the feeder 50, in a running step 94 the user runs the desired greeting card software application which, is discussed in the background section above, may be an application already loaded on a user's computer, or one accessible from the internet or other networking mechanisms. Once the software is up and running, in a selecting step 96, a user then selects which greeting card to print on the loaded sheet of media 62. Then in another selecting step 98, a user selects a print button feature on a software operating system which may accompany the greeting card feeder module, or another print feature, such as that which accompanies most word processing systems. Following the selecting step 98, the printer 20 then picks the sheet of media 62 from the feeder module 50 and in a printing step 100 prints first one side of a card, followed by the duplexer module 40 inverting the card stock to allow the printer to print on the other side of the card. Preferably to improve throughput, which is a term used to define the speed of printing typically measured in pages per minute, the side of the card having the shortest drying time is printed first. Most often the inside of the card has the shortest drying time because it typically has a text message, while the outside of the card usually has a more graphic design, so for most cards the inside message may be printed first. Following this printing, the freshly made greeting card is then delivered into the printer output tray 30, lying on top of the fixed base plate 52 and the pivoting plate 54, in a location generally extending over the feed slot 60.

Figure 6:
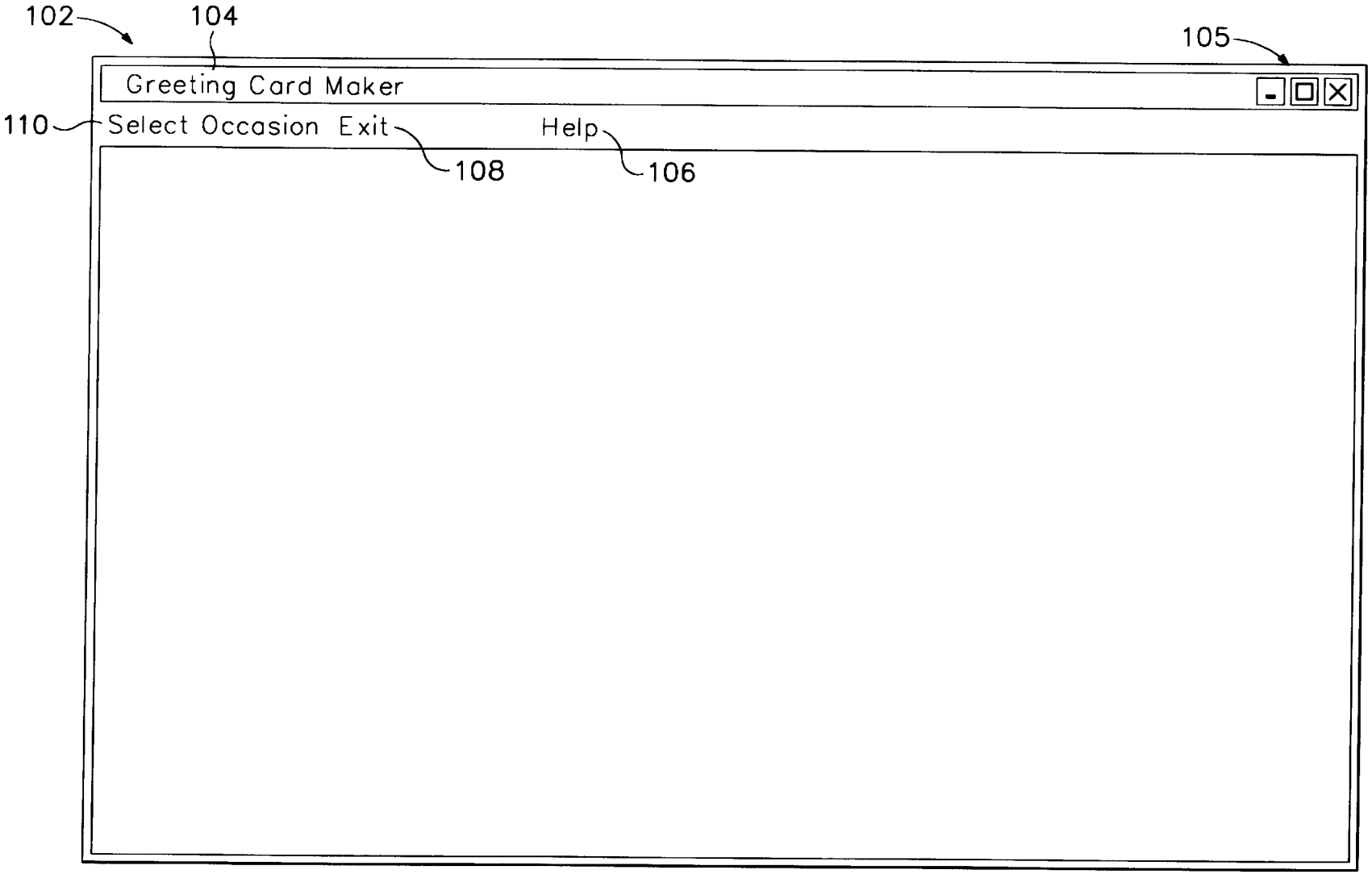
FIG. 6 is a front elevational view replicating a computer screen display of one form of a first display produced by the greeting card operating system of FIG. 1.
Figure 7:
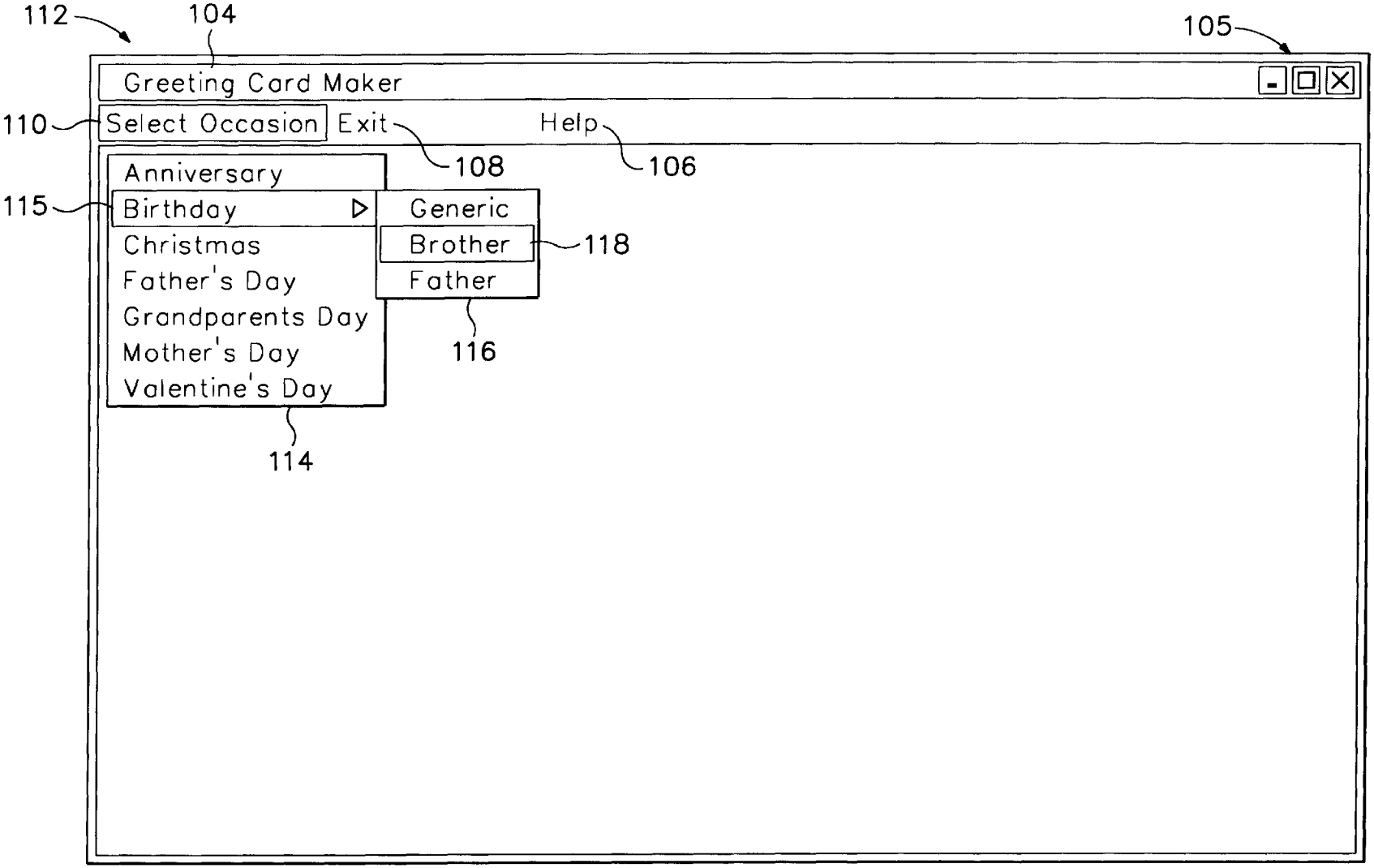
FIG. 7 is a front elevational view replicating a computer screen display of one form of a second display produced by the greeting card operating system of FIG. 1.
Figure 8:
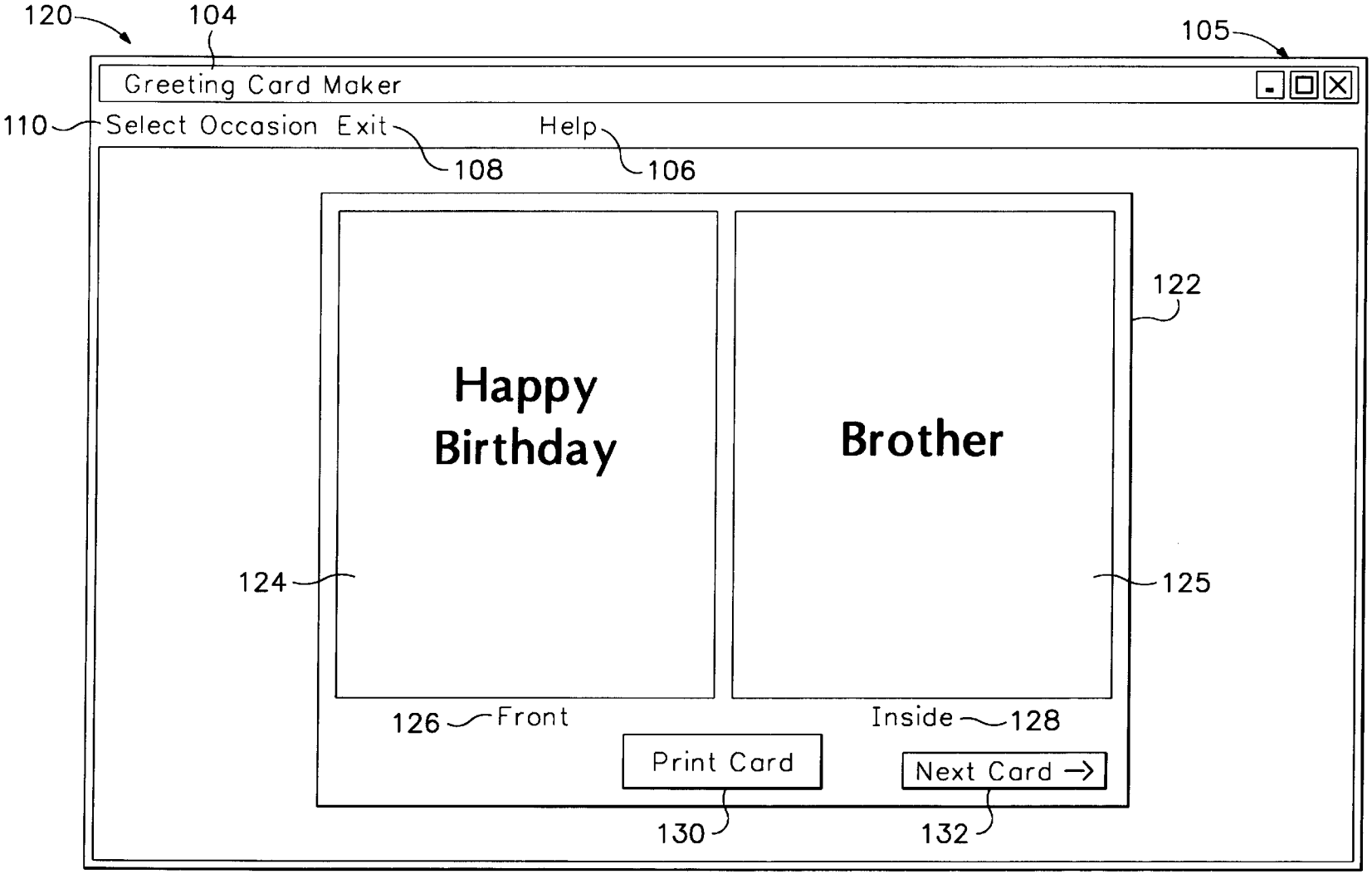
FIG. 8 is a front elevational view replicating a computer screen display of one form of a third display produced by the greeting card operating system of FIG. 1.

FIGS. 6–8 illustrate one form of a series of screen displays produced for user interaction when running the illustrated greeting card software of steps 94–98 shown in FIG. 4. FIG. 6 illustrates an opening screen display 102 of the software routine of step 94. The opening screen display 102 includes a title 104, here "greeting card maker," along with a conventional set of display sizing and program exiting options 105, a help request indicia 106, and an exit request 108. Also shown in the opening screen 102 is a select occasion option 110. FIG. 7 illustrates a second screen display 112 which is provided to a user after selecting the select occasion option 110 from screen display 102 in FIG. 6. The screen display 112 includes a greeting card menu 114, showing various holidays including anniversaries, birthdays, Christmas, Father's Day, Grandparent's Day, Mother's Day, and Valentine's Day as few examples. It is apparent that menu 114 may be expanded to include other holidays, such as Thanksgiving and Easter, Thank You cards, and Friendship cards.

In the illustrated example, a birthday card option 115 has been selected and the program has generated a secondary option menu 116. The secondary option 116 has several examples of different types of customized birthday cards including a generic card, one for a brother and one for a father. In the illustrated example, a brother option 118 has been selected to generate a birthday card for a brother. FIG. 8 shows a third screen display 120 which resulted from the selection of a birthday card for a brother on the display 112 of FIG. 7. Display 120 shows a card generation screen 122 which shows a first selection for a birthday card suitable to send to one's brother. The card generation screen 122 has an outside display portion 124 and a card interior display portion 125, which each have indicia thereunder such as the "front" indicia 126 and the "inside" indicia 128. If this is the desired card, the print card step 98 of FIG. 4 may then be implemented by selecting a print card option 130 on the card generation screen 122. If this is not the desired card to be sent, a user may browse through a library of cards stored within the program, by choosing a next card option 132 on the generation screen 122.

Thus, the next card option 132 forms a portion of the selecting a greeting card step 96 of FIG. 4, with the print card option 130 option being selected to complete the step and send printing instructions from a host computer device to the printer controller 30. By starting with step 94 to run the software application illustrated, in a minimum of three screen displays 102, 112 and 120, for instance, a greeting card may be selected and printed using the illustrated greeting card generation software application of steps 94–98, it is apparent that additional options and selections may be added to provide users with greater choices in the types of greeting cards by adding to the menu 114 and secondary menu 116 of FIG. 7, as well as adding additional greeting card selections which may be viewed on the card generation display 122. Furthermore, it is also apparent that the greeting card feeder module 50 may be used in conjunction with other greeting card software applications, beyond that illustrated in FIGS. 6–8, although the illustrated greeting card maker application preferred for its simplicity and ease of use.

Conclusion

Figure 5A:
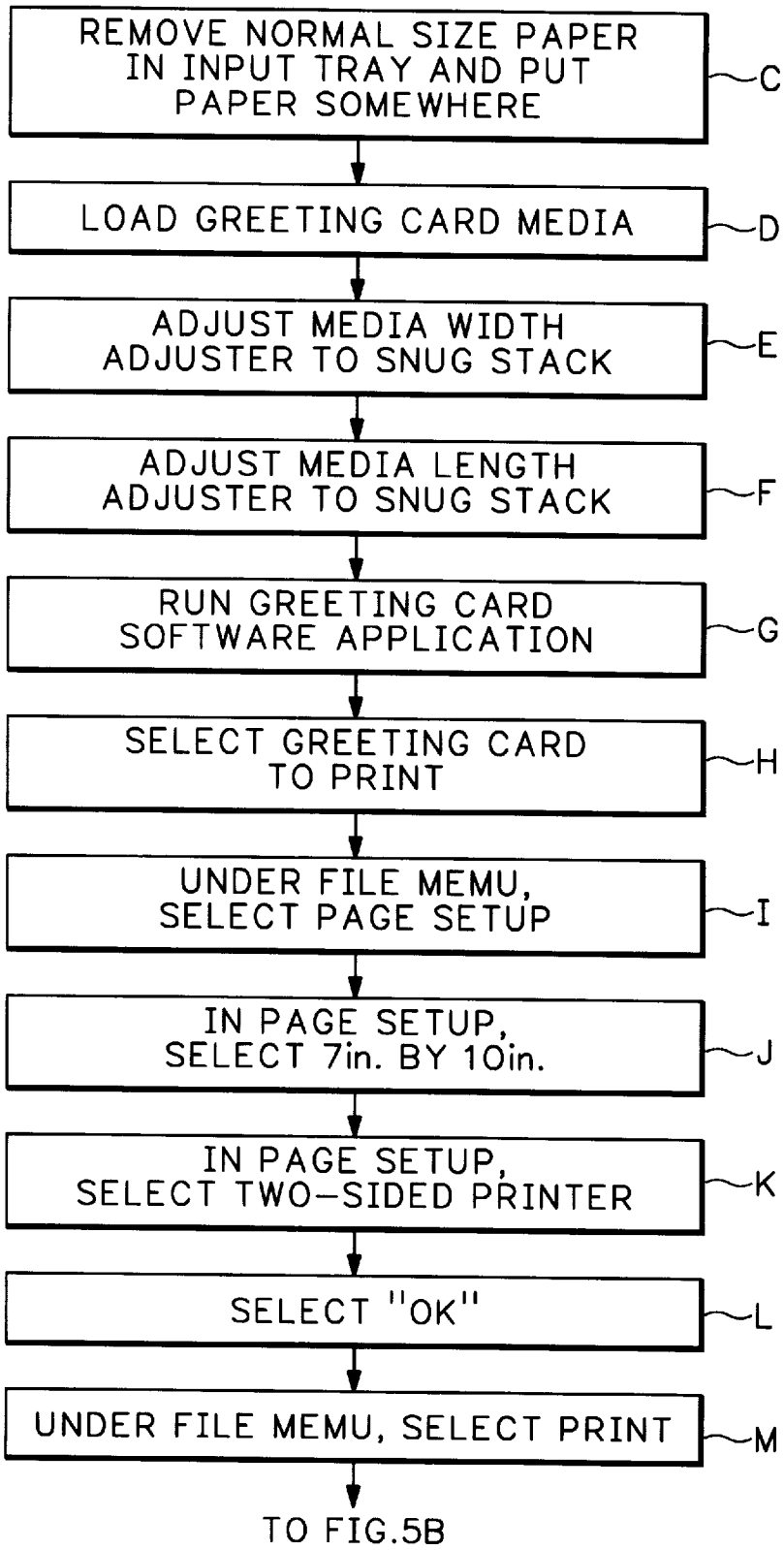
FIG.5A (PRIOR ART)
FIGS. 5A and 5B are two portions of a flow chart illustrating a commonly used, cumbersome, prior art manner of printing greeting cards.
Figure 5B:
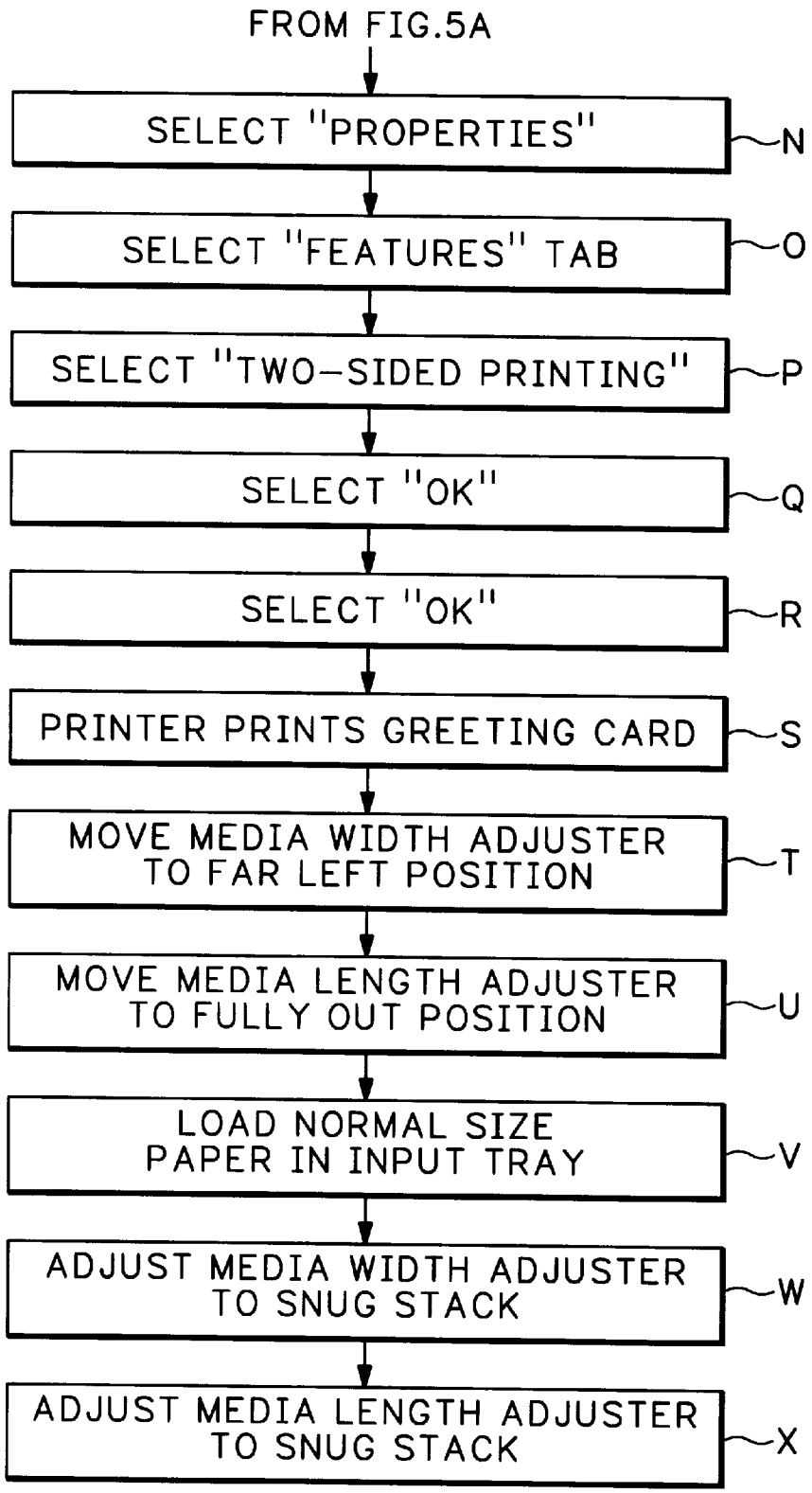
FIG.5B (PRIOR ART)

Thus, the new method capable of using the greeting card feeder 50 in conjunction with the duplexer unit 40 advantageously reduces the number of steps a user is required to employ to print a greeting card. For example, from the nearly 20 steps described in the background section with regard to the flowchart of FIGS. 5A and 5B, a user now performs five steps to print a greeting card. Granted, the running step 94 and the selecting step 96 are similar to steps G and H in the prior system, and step 100 is similar to step S, but the remaining two steps 92 and 98 are vast simplification over the methods which users had to employ previously to print greeting cards. Indeed, none of the earlier greeting card software applications had any manner for receiving an input from a user to indicate that a printer had auto-duplexing capability, such as that provided by the duplexer module 40. Thus, greeting cards printed from these earlier software applications were first printed usually on the exterior of the card, after which a user had to manually invert the sheet and reload it into the printer to print the inside of the card, further complicating the illustrated prior art operating system of FIGS. 5A and 5B. Indeed, some of these earlier software applications were not even designed to handle the special sized greeting card media, requiring a couple of extra steps to be inserted between the selecting steps P and Q. For instance, an additional selection might be required to reduce the greeting card content to fit a smaller area, such as the area of ¼ of a letter-sized sheet which, through careful folding and single sided printing could be fashioned into a homemade greeting card. Unfortunately these earlier greeting card software applications designed for letter-sized paper were limited to producing a greeting card which was only the size of a typical party invitation or thank-you note, but not the larger size of a typical birthday card or holiday greeting card. Furthermore, the letter-sized plain paper media was typically too flimsy and easily wrinkled, not leading to any type of a durable greeting card comparable to those available in the stores.

Using the illustrated greeting card feeder operating system 90, the number of steps required to successfully print a homemade greeting card having store bought type quality are drastically reduced. While some users may lament the loss of the capability to print many different sizes of greeting cards using the feeder module 50, the simplicity offered by this system is believed to be far more advantageous for the majority of users. Moreover, by eliminating the need to reconfigure the normal media input tray 42 to accommodate specially sized greeting card stock 62, the speed with which a greeting card can be printed is drastically increased. The quickness with which a commercial quality greeting card can be printed using the method of flowchart 90 and the card feeder module 50 in conjunction with duplexer 40 is a significant advantage for many users who perhaps at the last minute realize they have forgotten an important birthday or other event and don't have time to go to a store and shop for a card. Furthermore, the ease of use of the feeder module 50 and operating method 90 are particularly advantageous for users which only infrequently need to print a card and may have difficulty remembering all of the steps illustrated in FIGS. 5A and 5B when many months intervene between uses.

Another trade-off in flexibility and features versus ease of use of method 90 and the feeder module 50 was the elimination of the ability to personalize a greeting card using method 90. However, one of the main goals of the feeder module 50 and method 90 was to produce store bought quality greeting cards, and even store bought cards required a user to sign their name at a minimum or add other personal messages to the card by hand. In the future, the software could allow customization while adding only 1–2 steps above the simplest solution. Another trade-off made was the elimination of multiple media sizes for the card feeder. However, once again greeting card companies and stationery companies are tending to print more standard size cards to lower their media handling and purchasing costs. And finally, most people who receive a greeting card printed using the feeder module 50 and the method 90 are recipients of a gift, and they don't know what media sizes were available at the store or one's own home or office.

Thus, consumers now have a printing system which allows them to print store bought quality greeting cards at home or work using the new commercially available greeting card media using a reliable robust system which is not only fast but easy to use and which will no doubt save consumers money over purchasing store bought greeting cards.

We claim:

1. A method for printing images on a first-sized media and on opposing first and second surfaces a second-sized media, comprising the steps of:

providing a hardcopy printing mechanism having a frame, a first input device for storing a supply of the first-sized media, a duplexer unit for inverting media, a controller responsive to input signals to print images, and a second input device for receiving a sheet of the second-sized media;

loading a sheet of the second-sized media into the second input device;

initiating a software program having a selection of images each having a first portion and a second portion;

selecting one of the images from said selection of images;

generating input signals for the controller in response to said selecting step; and first printing the first portion of said selected one of the images on the first surface of the loaded sheet of second-sized media, and thereafter, printing the second portion of said selected one of the images on the second surface of the second-sized media, while retaining a supply of the first-sized media in the first input device.

2. A method according to claim 1 further including the step of inverting the loaded sheet using the duplexer unit after the first printing step.

3. A method according to claim 1 further including the step of generating an initial display for display on a computer monitor.

4. A method according to claim 3 further including the step of generating another display having a list of image selections for display on the computer monitor.

5. A method according to claim 4 further including the step of generating an additional display having a representation of an image selected from the list for display on a computer monitor.

6. A method according to claim 5 wherein said additional display includes a browsing feature selectable to view representations of other images on the list.

7. A method according to claim 6 wherein said additional display includes a print feature selectable to initiate the step of generating input signals for the controller.

8. A method according to claim 3 further including the steps of Generating a category display having a list of image categories for display on the computer monitor, including an image category selection feature, and generating a further sublist display having a sublist of image categories for display on the computer monitor, including a sublist image selection feature.

9. A method according to claim 8 further including the step of generating an additional display having a representation of an image selected from the list for display on a computer monitor, with said additional display including a browsing feature selectable to view representations of other images on the list and a print feature selectable to initiate the step of generating input signals for the controller.

10. A method according to claim 1 wherein the second-sized media comprises greeting card stock.

11. A method according to claim 1 wherein the hardcopy printing mechanism comprises an inkjet printer.

12. A method according to claim 1 wherein said second supply device comprises an output tray defining a slot therein for receiving said second-sized media.

13. A method according to claim 12 wherein said second-sized media comprises greeting card stock having a width and a length, and the output tray defines said slot to have a width sized to receive said width of the greeting card media during said loading step.

14. A method according to claim 13 wherein the providing step further comprises providing the hardcopy printing mechanism as including an alignment surface, and a first width adjustment member which is adjustable to push the first-sized media against the alignment surface.

15. A method according to claim 14 wherein the providing step further comprises providing the hardcopy printing mechanism with the second input device including a biasing member which pushes the second-sized media against the alignment surface during said loading step.

* * * * *